United States Patent [19]

Principe

[11] 4,372,235

[45] Feb. 8, 1983

[54] THREAD MONITORING DEVICE

[75] Inventor: Viktor Principe, Romanshorn, Switzerland

[73] Assignee: Arthur Schmid AG, Romanshorn, Switzerland

[21] Appl. No.: 267,020

[22] Filed: May 26, 1981

[51] Int. Cl.[3] ..... D05B 69/36

[52] U.S. Cl. ..... 112/273; 28/187; 200/61.18

[58] Field of Search ..... 112/273, 278; 57/81; 28/187; 200/61.18, 61.13; 242/148; 19/0.25; 66/163, 164, 162

[56] References Cited

U.S. PATENT DOCUMENTS

| | | | |
|---|---|---|---|
| 1,372,556 | 3/1921 | Sawtell | 28/187 |
| 3,009,433 | 11/1961 | Kuhn | 112/273 |
| 4,269,131 | 5/1981 | Principe | 112/273 |
| 4,306,231 | 12/1981 | Bagnall et al. | 112/278 X |

*Primary Examiner*—Peter P. Nerbun

*Attorney, Agent, or Firm*—Tilton, Fallon, Lungmus & Chestnut

[57] ABSTRACT

A thread monitoring device wherein the broken tension on a thread (or threads) is sensed by a biased spring to close an electric circuit yielding an audible or visual signal.

5 Claims, 5 Drawing Figures

Fig.1
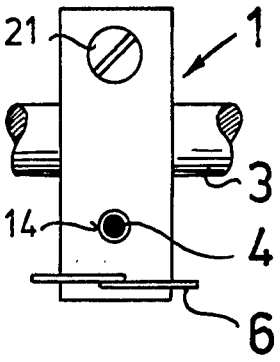
Fig.2
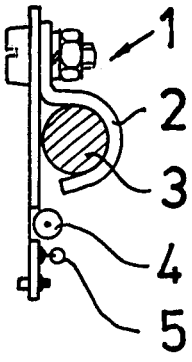
Fig.3
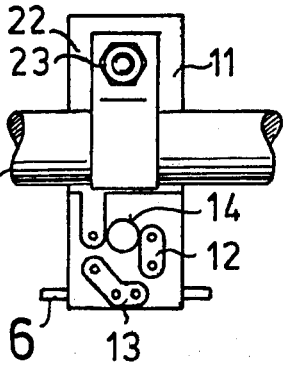
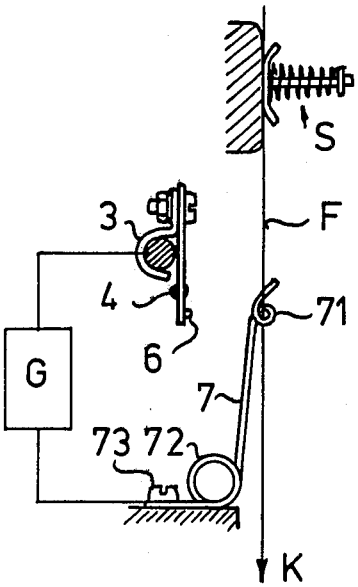
Fig.5
Fig.4
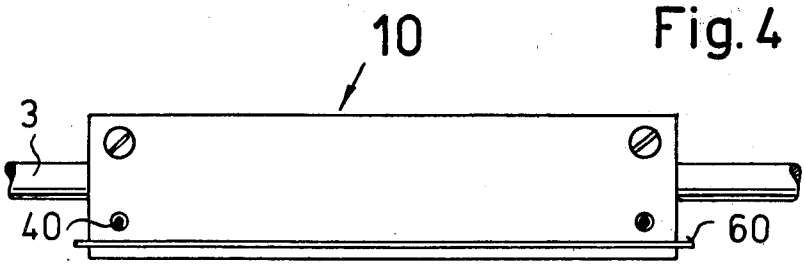

THREAD MONITORING DEVICE

BACKGROUND AND SUMMARY OF INVENTION

This invention relates to a thread monitoring device and, more particularly, to a device for giving a signal when a tensioned thread is broken. The thread monitoring device is especially suited for stitching machines but it can be used also for other machines working with a multitude of needles.

On a well-known monitoring device of this type, one had to search frequently and for a rather long time for the thread which had broken and caused the disturbance. This is especially the case on stitching machines where the spacings between the individual threads are different depending on the pattern to be stitched.

It is the object of the invention to provide a monitoring device which permits the monitoring of each individual thread or of a relatively small group of threads and which shows optically the broken thread or the group from which a thread had broken—this without the necessity to search. It is thereby immediately recognizable which thread is broken.

The invention solves the aforesaid problem by a device in which for each individual thread or for a group of threads there is arranged a movable holder which is movable on a current carrying rail and has a contact strip having a corresponding length and a light diode.

If, for instance, a stitching machine is equipped with tensioning devices for fifty threads but the pattern is stitched with only twelve threads, it is possible with the thread monitoring device to monitor the twelve threads individually and to move the holders on the rail corresponding to the pattern to be stitched so that they are directed to these twelve threads and monitor them individually. If a thread breaks during the operation, the diode on the respective holder indicates immediately the thread which is broken. If one operates with a large number of threads, a holder with a wide contact strip can be used—with the breaking of a thread, of the group thus combined being indicated. Such a group includes only four to eight threads so that also in this case one does not have to look long for the thread which is broken.

DETAILED DESCRIPTION

The invention is described in conjunction with the accompanying drawing, in which:

FIGS. 1–3 show a holder for individual thread monitoring seen from the front, from the side and from the rear, at an enlarged scale;

FIG. 4 shows a holder for the monitoring of a group of five threads; and

FIG. 5 shows a simplified illustration of the device.

For each thread to be monitored, a flexible contact arm which has a thread guiding eye is held at a distance from a contact strip by the tensioned thread whereas, in case the thread breaks, the contact arm touches the contact strip, triggers an alarm and/or stops the machine. The mode of operation of the device can be explained by means of FIG. 5. S is a tensioning device for the thread F which is guided through the eye 71 of the flexible contact arm 7. The thread tension K holds the contact arm in the illustrated position.

The contact arm is made of steel wire and includes a torsion spring part 72 which is held at 73 on part of the sawing machine. To the rail 3 and the connection 73 shared by all contact arms there is connected a control device G supplying the voltage—also suitably mounted on the machine frame. To the electronic control device there can also be connected a shut-off device—not shown—which shuts off the machine with adjustable time delay. A time delay is useful since because of a disturbance lasting a short time a thread can hang slack without breaking.

In FIGS. 1–3, 1 is a holder of insulating material which is designed as a conducting plate and on whose back side conducting paths 11–13 are located. The holder is clamped movable on a current carrying rail by means of a clamping part 2, a screw 21, a washer 22 and a nut 23. The conducting path 11 provides here an electrically conducting connection with the rail 3. A light diode 4 is soldered onto the conducting path 11 and 12. It is partly in a passage opening 14 in the conducting plate so that it is well visible from the front side. A series resistance 5 is soldered to the conducting paths 12 and 13. The contact strip 6 consists of two hook-shaped wire pieces which are located on the front side of the conducting plate 1 but on the back side are soldered onto the conducting path 13. They overlap each other a little on the front side in order to form a continuous strip.

In operation, the tension K in the thread (F) keeps the flexible contact arm (7) at a distance from the contact strip (6). If a thread breaks during operation, the arm (7) bears on the contact strip (6). The consequence thereof is an optical indication since the light diode (4) lights up then and the machine is turned off. The optical indication permits immediate detection without searching for the broken thread. Thereby the fault can be eliminated quickly, the downtime of the machine can be shortened, the defectively stitched portion remains small and can possibly be repaired.

In FIG. 4, a holder 10 for monitoring a group of five threads is illustrated. It is fastened on the rail 3 by means of two clamping parts and contains two light diodes 40. The length of the contact strip 60 corresponds to the spacing of the five threads to be monitored. If a thread of this group breaks, both diodes light up and the machine is turned off.

What is claimed is:

1. Thread monitoring device especially for stitching machines that has for each thread to be monitored a flexible contact arm which has a thread guiding eye and is held at a distance from a contact strip by the thread in a tensioned state whereas in case the thread breaks the contact arm touches the contact strip, triggers an alarm and/or stops the machine, characterized by the fact that for each individual thread or for a group of threads there is arranged a movable holder (1, 10) which is movable on a current carrying rail (3) and has a contact strip (6) having a corresponding length and a light diode (4), the contact arm being mounted on a surface detached from the movable holder.

2. Device as defined in claim 1, characterized by the fact that the holder is designed as a conducting plate (11, 12, 13) which by means of a clamping part (2) produces the electric connection to the current carrying rail (3), carries the contact strip (6) and connects said contact part with the current carrying rail (3) by way of the light diode (4) and a series resistance (5).

3. Device as defined in claim 2, characterized by the fact that the contact strip (6) lies on the non-coated side of the contacting plate whereas the series reistance (5)

and the light diode (4) are soldered onto the other side with the latter one being located behind a passage opening (14).

4. Device as defined in claim 1, characterized by the fact that the holder (10) intended for a group of threads is provided with a light diode (40) on both sides.

5. A thread monitoring device for a multineedle sewing machine comprising a plurality of flexible contact arms mounted on said machine, one for each thread to be monitored, and maintained in a first position by the tension of the monitored thread, said contact arm being spring urged toward a second position upon the absence of the monitor thread, said machine being equipped with a current carrying rail adjacent said second position, a holder movably mounted on said rail and adapted to be releasably fixed thereon in alignment with at least one contact arm, said holder having a conducting plate depending from said rail in the path of movement of said contact arm as said contact arm moves toward said second position, a contact strip on said conducting plate engageable by said contact arm when the same moves toward said second position, an electrical circuit operably associated with said machine including a current source connecting said contact arm and said contact strip through said rail, holder and conducting plate and including an illuminable diode mounted on said conducting plate adjacent said contact strip, said diode being illuminated when said contact arm contacts said contact strip to complete the electrical circuit whereby said holder can be selectively positioned on said rail in alignment with any selected contact arm to indicate breakage of a monitored thread associated with said selected contact arm.

* * * * *